US010815987B2

(12) United States Patent
Todal et al.

(10) Patent No.: US 10,815,987 B2
(45) Date of Patent: Oct. 27, 2020

(54) PUMP PROTECTION METHOD AND SYSTEM

(71) Applicant: FMC Kongsberg Subsea AS, Kongsberg (NO)

(72) Inventors: Karen Todal, Haslum (NO); Helge Grøtterud, Kongsberg (NO)

(73) Assignee: FMC Kongsberg Subsea AS, Kongsberg (NO)

( * ) Notice: Subject to any disclaimer, the term of this patent is extended or adjusted under 35 U.S.C. 154(b) by 382 days.

(21) Appl. No.: 15/770,198

(22) PCT Filed: Nov. 3, 2016

(86) PCT No.: PCT/EP2016/076491
§ 371 (c)(1),
(2) Date: Apr. 21, 2018

(87) PCT Pub. No.: WO2017/076939
PCT Pub. Date: May 11, 2017

(65) Prior Publication Data

US 2018/0313349 A1 Nov. 1, 2018

(30) Foreign Application Priority Data

Nov. 5, 2015 (NO) ..... 20151500

(51) Int. Cl.
*F04B 49/06* (2006.01)
*F04D 15/00* (2006.01)
(Continued)

(52) U.S. Cl.
CPC ..... *F04B 49/065* (2013.01); *F04B 15/00* (2013.01); *F04B 49/06* (2013.01); *F04B 49/106* (2013.01);
(Continued)

(58) Field of Classification Search
CPC .. F04C 14/28; F04C 28/28; F04C 2210/1061; F04C 2210/206; F04C 2210/203;
(Continued)

(56) References Cited

U.S. PATENT DOCUMENTS

2007/0212229 A1* 9/2007 Stavale ..... F04D 15/0209 417/42
2011/0223038 A1 9/2011 Ogawa et al.
(Continued)

FOREIGN PATENT DOCUMENTS

WO WO 2012/154160 A1 11/2012
WO WO 2013/006075 A1 1/2013
WO WO 2015/140622 A1 9/2015

*Primary Examiner* — Bryan M Lettman

(57) ABSTRACT

Protecting a hydrocarbon pump from excessive flow rates in a hydrocarbon fluid system comprising an electrical motor for driving the pump. For each of a plurality of gas volume fraction values of the hydrocarbon fluid, establishing a maximum torque limit for the pump by mapping the maximum allowable torque of the pump as a function of the differential pressure, thereby creating a plurality of maximum torque curves, each representing the maximum torque limit for a unique gas volume fraction value. Establishing a master maximum torque curve which represents the maximum torque limit for all gas volume fraction values. Monitoring the torque of the pump and the differential pressure across the pump. Based on the monitored differential pressure and using the master maximum torque curve, establishing a maximum allowable torque for the pump. Taking action if the monitored torque exceeds the established maximum allowable torque.

19 Claims, 2 Drawing Sheets

(51) Int. Cl.

| | |
|---|---|
| ***F04C 14/28*** | (2006.01) |
| ***F04C 28/28*** | (2006.01) |
| ***F04B 51/00*** | (2006.01) |
| ***F04B 15/00*** | (2006.01) |
| ***F04D 27/00*** | (2006.01) |
| ***F04B 49/10*** | (2006.01) |

(52) U.S. Cl.
CPC ..... *F04B 51/00* (2013.01); *F04C 14/28* (2013.01); *F04C 28/28* (2013.01); *F04D 15/0077* (2013.01); *F04D 15/0088* (2013.01); *F04D 27/001* (2013.01); *F04B 2203/0207* (2013.01); *F04B 2205/09* (2013.01); *F04C 2210/40* (2013.01); *F04C 2270/015* (2013.01)

(58) Field of Classification Search
CPC ..... F04C 2210/40; F04C 2210/60; F04C 2210/62; F04C 2270/01; F04C 2270/015; F04C 2270/86; F04D 15/0077; F04D 15/0088; F04D 27/001; F04B 15/00; F04B 49/10; F04B 49/106; F04B 2203/0207; F04B 2205/09; F04B 49/06; F04B 49/065; F04B 51/00
See application file for complete search history.

(56) References Cited

U.S. PATENT DOCUMENTS

| | | | | |
|---|---|---|---|---|
| 2013/0251540 | A1 | 9/2013 | Paulus et al. | |
| 2015/0370262 | A1* | 12/2015 | Hanaoka ..... | F04D 13/06 137/557 |
| 2018/0314270 | A1* | 11/2018 | Grotterud ..... | F04D 13/12 |

* cited by examiner

PUMP PROTECTION METHOD AND SYSTEM

FIELD OF THE INVENTION

The present invention relates to a method of protecting a hydrocarbon pump from excessive flow rates in a system for pumping a hydrocarbon fluid, which system comprises said pump and an electrical motor for driving the pump.

The present invention also relates to a system comprising a pump and an electrical motor for driving the pump, which system operates according to the method.

In particular, the present invention relates to a method and a system for pumping a fluid comprising hydrocarbons in a subsea hydrocarbon production or processing complex.

BACKGROUND

Basically, multiphase pumps are used to transport the untreated flow stream produced from oil wells to downstream processes or gathering facilities. This means that the pump may handle a flow stream (well stream) from 100 percent gas to 100 percent liquid and every imaginable combination in between. In addition to hydrocarbons, the flow stream can comprise other fluids, e.g. water, and solid particles, e.g. abrasives such as sand and dirt.

Consequently, hydrocarbon multiphase pumps need to be designed to operate under changing process conditions and must be able to handle fluids having varying gas volume fractions (GVF) and/or densities. Also, the operational envelope of the pump changes with changing inlet pressure.

In the following, the term "hydrocarbon fluid" will be used to denote a multiphase or single phase fluid comprising hydrocarbons.

In hydrocarbon fluid pumps, high flow rates, which may occur when the pump operates in the high flow region of the pump envelope, are potentially damaging to the pump and should therefore preferably be avoided or limited in time.

US 2013/251540 A1 discloses a displacement pump arrangement and a control device for controlling the displacement pump arrangement to provide rotational speed-variable control of an expeller pump unit for feeding a fluid. The arrangement includes an expeller pump and a drive, the drive being composed of an electric drive motor and a frequency converter, and a control device.

WO 2015/140622 A1 discloses a pump control system, comprising a motor configured to drive a pump, a pressure relief valve in fluid communication with the pump, a torque control valve connected to a swashplate of the pump and in fluid communication with the pressure relief valve, a swashplate angle sensor connected to the swashplate, and a computer connected to the swashplate angle sensor and the pressure relief valve, wherein the computer controls the pressure relief valve based upon swashplate displacement to achieve maximum system pressure.

US 2007/212229 A1 discloses a method of providing protection for centrifugal pumps while differentiating between dangerous operating conditions and/or conditions where transient conditions may occur and the protection can be revoked once the condition clears. The methodology utilizes a calculated flow value which can be mathematically determined from a calibrated closed valve power vs speed curve and/or various pump and motor parameters such as speed, torque, power and/or differential pressure or from calibrated flow curves stored in the evaluation device. The calculated flow value is then compared to threshold values of flow associated with these adverse operating conditions.

US 2011/223038 A1 discloses a controller-integrated motor pump. The motor pump includes a pump; a motor configured to drive the pump; a control unit configured to control the motor, and a pressure measuring device configured to measure pressure of fluid at a discharge side of the pump. The control unit is mounted on a motor casing. The control unit includes an inverter configured to produce alternating-current power having a frequency within a band that includes frequencies more than or equal to a commercial frequency, a pump controller configured to produce a torque command value for controlling operation of the pump, and a vector controller configured to determine a voltage command value for the inverter based on the torque command value.

The conventional method of detecting maximum flow conditions is to monitor the flow through the pump by using a flow meter. For multiphase fluids the maximum flow limitation varies with the gas volume fraction (GVF) of the fluid—where an increasing gas volume fraction, at a given differential pressure value, gives a higher maximum allowable flow rate.

Consequently, the conventional method of detecting high flow rate conditions when pumping a multiphase hydrocarbon fluid is by using a multiphase flow meter capable of measuring the gas volume fraction of the fluid as well as the flow rate. However, such multiphase flow meters are expensive and a significant driver of cost in hydrocarbon fluid pumping systems. Consequently, there exists a need for an alternative method and system for protecting hydrocarbon pumps from excessive flow rates.

An object of the present invention is to solve this problem and provide an alternative method and system of warning for excessive flow rates.

Another object of the invention is to enable protection of the pump from operating in the high flow region of the pump envelope without having to measure the gas volume fraction of the fluid or the flow rate through the pump.

SUMMARY OF THE INVENTION

The method according to the invention is characterised by the steps of:

- for each of a plurality of gas volume fraction values of the hydrocarbon fluid, establishing a maximum torque limit for the pump by mapping the maximum allowable torque of the pump as a function of the differential pressure across the pump, thereby creating a plurality of maximum torque curves, each representing the maximum torque limit for a unique gas volume fraction value,
- from the plurality of maximum torque curves, establishing a master maximum torque curve which represents the maximum torque limit for all gas volume fraction values,
- monitoring the torque of the pump and the differential pressure across the pump,
- based on the monitored differential pressure and using the master maximum torque curve, establishing a maximum allowable torque for the pump, and
- taking a predetermined action if the monitored torque exceeds the established maximum allowable torque.

Consequently, according to the invention a maximum torque limit is utilised to protect the pump from operating in the high flow region of the pump envelope. Using a maximum torque limit is particularly useful when the pump is pumping a multiphase fluid since it has been observed that the maximum torque limit is less dependent of the gas volume fraction of the fluid than is the maximum flow limit. In other words, it has been observed that the maximum torque limit does not shift much when the gas volume fraction of the fluid varies.

Using the method according to the invention, expensive multiphase flow meters associated with prior art control methods can be dispensed with. It is to be understood that the method according to the invention is particularly advantageous when used in subsea pumping systems since subsea operation of multiphase flow meters no longer is needed.

Whereas the advantages associated with the method according to the invention is most prominent when pumping multiphase fluids, the method is also valid for single phase pumps, although the potential cost reduction in such systems is lower.

It may be advantageous that the step of taking a predetermined action comprises raising an alarm and/or shutting down the system.

Alternatively or in addition, it may be advantageous that the step of taking a predetermined action comprise the step of regulating the system such that the monitored torque is reduced.

It may be advantageous that the step of monitoring the torque of the pump comprises monitoring the power and the speed of the pump and calculating the torque of the pump based on the monitored power and speed.

It may be advantageous that the step of monitoring the power and the speed of the pump comprises sampling output power from a variable speed drive controlling said motor.

It may be advantageous that the step of calculating the torque of the pump comprises compensating for mechanical and/or electrical losses in the system, e.g. losses at a pump shaft of the pump.

The master maximum torque curve may advantageously, for each differential pressure value, have a lower torque value than for the corresponding torque values of the maximum torque curves.

The step of establishing the master maximum torque curve may advantageously comprise positioning the master maximum torque curve adjacent to and on the permissible operating side of the maximum torque curves.

The step of establishing the master maximum torque curve may advantageously comprise applying a linear or second degree polynomial approximation algorithm to said plurality of maximum torque curves.

Said method may advantageously be implemented in a subsea hydrocarbon fluid pumping system.

In the following, an embodiment of the invention will be discussed in more detail with reference to the appended drawings.

DETAILED DESCRIPTION OF THE INVENTION

Figure 1:
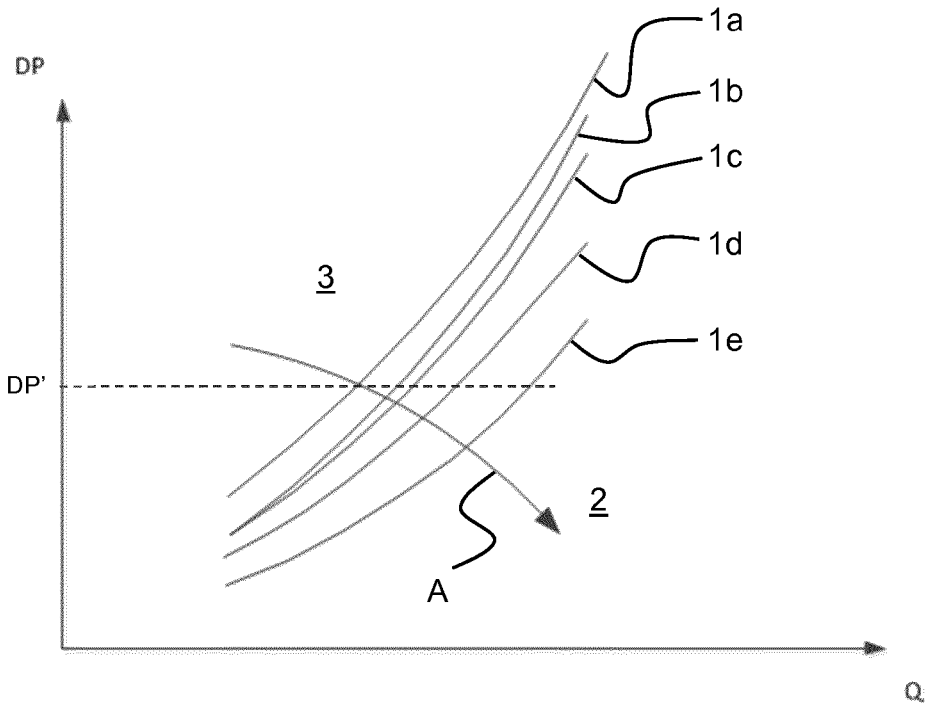
FIG. 1 discloses a DP-Q diagram conventionally used to illustrate the maximum flow limits of a pump in a fluid pumping system.

FIG. 1 discloses a conventional pump limit characteristics diagram 1 for a hydrocarbon pump where the differential pressure DP across the pump is mapped as a function of the volumetric flow Q through the pump for different gas volume fractions of the fluid being pumped. This type of diagram is conventionally referred to as a DP-Q diagram. The diagram discloses a plurality of pump limit characteristics curves 1*a*-1*e* for different gas volume fraction values. The curve 1*a* represents the maximum flow limit for a first gas volume fraction, $GVF_a$, the curve 1*b* represents the maximum flow limit for a second gas volume fraction, $GVF_b$, etc., where $GVF_a<GVF_b<GVF_c<GVF_d<GVF_e$, and where the curves 1*a*-1*e* define an impermissible operating region 2 and a permissible operating region 3 of the pump. As is indicated by the arrow A, for a given differential pressure value DP' the pump limit characteristics curves 1*a*-1*e* shift towards higher flow values when the gas volume fraction increases. Consequently, in order to establish the pump limit characteristics curve for a multiphase fluid in a DP-Q diagram, the flow rate as well as the gas volume fraction of the fluid need to be measured which, as was discussed above, requires the use of complex and expensive multiphase flow meters.

Figure 2:
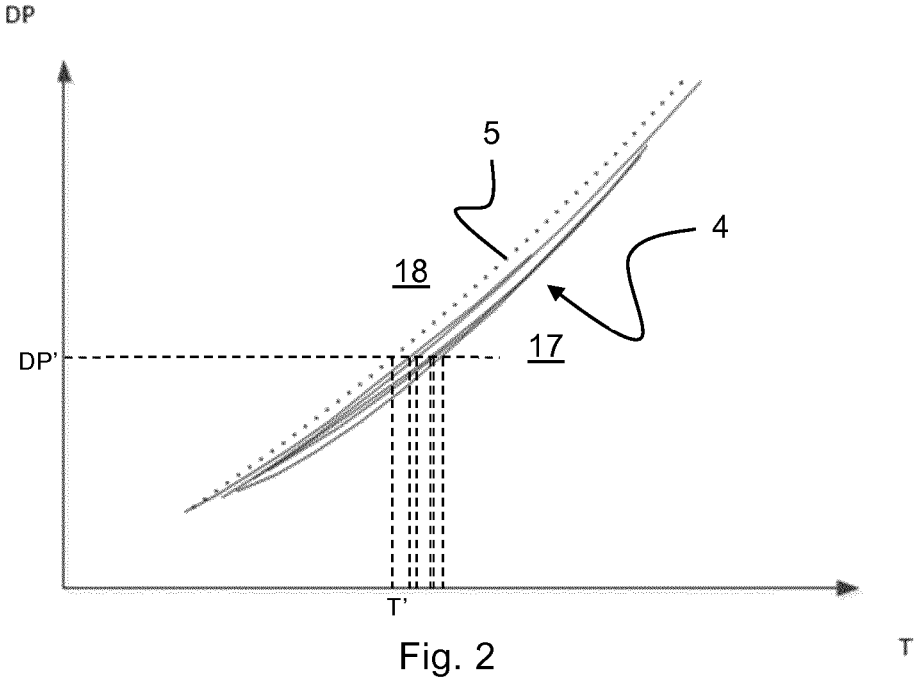
FIG. 2 discloses a diagram of an alternative, novel way of illustrating the maximum flow limits of a pump in a fluid pumping system.

FIG. 2 discloses an alternative, novel way of illustrating the operational range of a pump. In FIG. 2 the differential pressure across the pump, DP, is mapped as a function of the pump torque T for the same gas volume fraction values as in FIG. 1, thus forming a set of pump limit characteristics curves in the form of maximum torque lines or curves 4. As with the curves 1*a*-1*e* in FIG. 1, the maximum torque curves 4 define an impermissible operating region 17 and a permissible operating region 18 of the pump. As is apparent from FIG. 2, the maximum torque lines or curves 4 are concentrated to a more restricted region than are the pump limit characteristics curves 1*a*-1*e* in FIG. 1. In other words, the maximum torque curves 4 do not shift much when the gas volume fraction of the fluid varies.

Consequently, if the differential pressure across the pump is mapped as a function of the pump torque T instead of the flow rate Q, it is possible to establish a master maximum torque line or curve 5 which is representative for all gas volume fractions of the fluid, as is indicated by the dotted line in FIG. 2. In other words, based on the maximum torque curves 4, a master maximum torque curve 5 can be established which represents the maximum flow limit for all gas volume fractions of the fluid.

The master maximum torque curve 5 may be established by mapping the differential pressure DP across the pump as a function of the pump torque T for a set of different gas volume fraction values, thus obtaining a cluster of maximum torque curves 4, and then positioning the master maximum torque curve 5 adjacent to and on the permissible operating side 18 of the maximum torque curves 4. For example, it may be advantageous that the master maximum torque curve 5 is positioned as close as possible to but on the permissible operating side of the cluster of maximum torque curves 4. However, for any given differential pressure value DP', the master maximum torque curve 5 should be positioned at a lower torque value T' than for the corresponding torque values of the maximum torque curves 4, as is illustrated in FIG. 2. Given this criteria, a linear or second degree polynomial approximation algorithm can be used to establish the master maximum torque curve 5 from the cluster of maximum torque curves 4.

When choosing said set of different gas volume values, it is advantageous that the set covers the intended or expected range of gas volume fraction values, i.e. gas fraction volumes representing the whole operational range of the pump.

Figure 3:
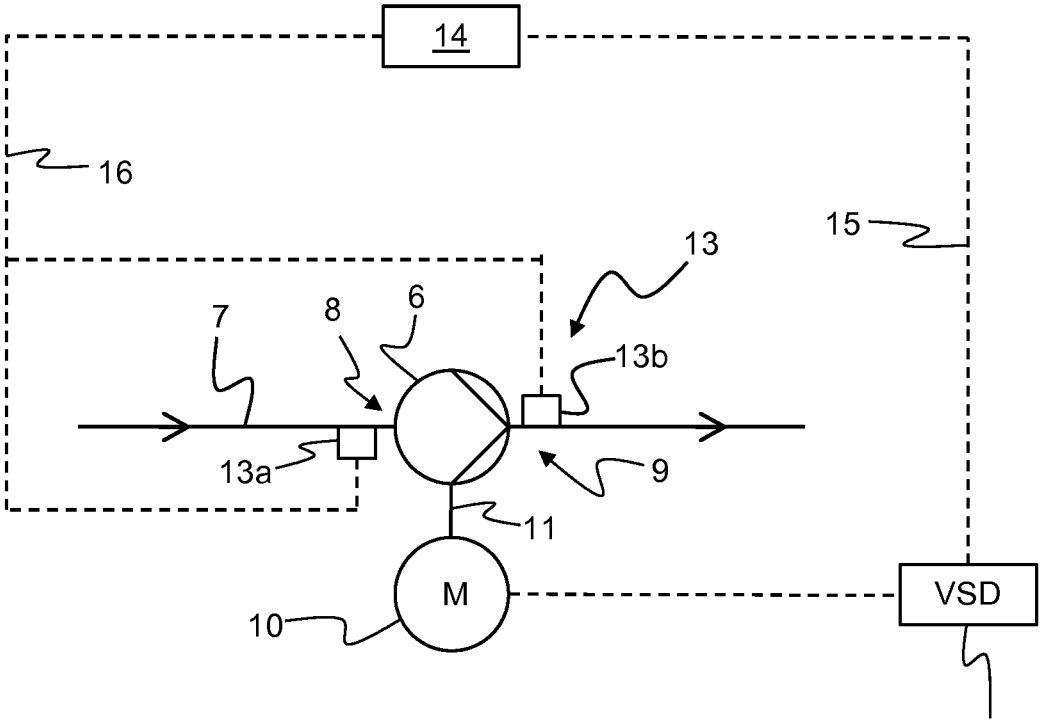
FIG. 3 discloses a hydrocarbon fluid pumping system according to an embodiment of the invention.

FIG. 3 discloses a hydrocarbon fluid pumping system in which the method according to the invention can be realised. The system comprises a pump 6 mounted on a hydrocarbon fluid conduit 7. The pump 6 has a suction side 8 and a discharge side 9. The pump 6 may advantageously be a helicoaxial (HAP) or centrifugal type pump. The system further comprises an electrical motor 10 for driving the pump 6 via a shaft 11. The motor 10 is advantageously a variable speed motor which is controlled by a variable speed drive, VSD 12.

In order to monitor a parameter indicative of the differential pressure across the pump 6, the system comprises a first measuring or sensor device 13. This sensor device 13 may advantageously comprise one or a plurality of pressure sensors arranged to monitor the differential pressure across the pump 6, e.g. a first pressure sensor 13*a* positioned upstream of the pump 6 and a second pressure sensor 13*b* positioned downstream of the pump 6.

The system further comprises a control unit 14 which is connected to the variable speed drive 12 and to the sensor device 13 via control conduits 15 and 16, respectively.

Using this system, the method according to the invention comprises the steps of establishing, for each of a plurality of gas volume fraction values of the hydrocarbon fluid in the conduit 7, a maximum torque limit for the pump 6 by mapping the maximum allowable torque of the pump 6 as a function of the differential pressure across the pump 6, thereby creating a plurality of maximum torque curves 4 (cf. FIG. 2), each representing the maximum torque limit for a unique gas volume fraction value of the hydrocarbon fluid.

From the plurality of maximum torque curves 4, a master maximum torque curve 5 is established, which master maximum torque curve 5 represents the maximum torque limit for all gas volume fraction values. Consequently, the master maximum torque curve 5 will define the rightmost delimiting border, or edge, of an allowable envelope or operating region of the pump 6 which is to be valid for all gas volume fractions of the hydrocarbon fluid. The master maximum torque curve 5 is established as an approximation for the cluster of maximum torque curves 4, e.g. as has been described above in relation to FIG. 2.

Once the master maximum torque curve 5 is established, it is stored in the system, e.g. as a look-up table in the control unit 14.

During operation of the system, the differential pressure across the pump 6 is monitored using the sensor device 13.

Also, the motor torque is monitored, e.g. by monitoring the power and the speed of the pump 6 and calculating the torque of the pump 6 based on the monitored power and speed. Advantageously, the step of monitoring the power and the speed of the pump 6 comprises sampling output power and pump speed from the variable speed drive 12.

For example, the pump torque can easily be calculated from the power and the pump speed with the following function:

$$T=(P\cdot 60000)/(2\cdot\pi\cdot N)$$

where the torque T is given in Nm, the power P in kW and the pump speed N in rounds per minute.

If the torque of the pump 6 is calculated based on the output from the variable speed drive 12, it may be advantageous if due account is taken to estimated mechanical and/or electrical losses in the system, i.e. electrical losses in the motor 10 and in the energy supply system of the motor 10 and mechanical losses to the pump shaft 11, such that the calculated torque reflects the true torque at the pump 6.

In subsea pumping systems, it may be particularly advantageous to sample the variable speed drive 12 for the pump torque as the variable speed drive is generally easily accessible topside, i.e. above sea level.

The monitored differential pressure signal is sent to the control unit 14 via the signal conduit 16, and using the stored master maximum torque curve 5 stored therein, a maximum allowable torque T' corresponding to the monitored differential pressure DP' is established (cf. FIG. 2). Likewise, the monitored motor torque is sent to the control unit 14 via the signal conduit 15. In the control unit 14, the established maximum allowable torque T' is compared to the monitored torque, and if the monitored torque exceeds the maximum allowable torque T', a predetermined action is taken, e.g. the raising of an alarm and/or shutting down the system.

In the preceding description, various aspects of the invention have been described with reference to the illustrative figures. However, this description is not intended to be construed in a limiting sense. Various modifications and variations of the illustrative embodiment, as well as other embodiments of the apparatus, which are apparent to persons skilled in the art to which the disclosed subject matter pertains, are deemed to lie within the scope of the present invention as defined by the following claims.

The invention claimed is:

1. A method of protecting a hydrocarbon pump from excessive flow rates in a system for pumping a hydrocarbon fluid, which system comprises said pump and an electrical motor for driving the pump, the method comprising the steps of:

for each of a plurality of gas volume fraction values of the hydrocarbon fluid, establishing a maximum torque limit for the pump by mapping a maximum allowable torque of the pump as a function of a differential pressure across the pump, thereby creating a plurality of maximum torque curves, each representing the maximum torque limit for a unique gas volume fraction value;

from the plurality of maximum torque curves, establishing a master maximum torque curve which represents the maximum torque limit for all said gas volume fraction values;

monitoring a torque of the pump and a differential pressure across the pump;

based on the monitored differential pressure (DP') and using the master maximum torque curve, establishing a maximum allowable torque (T') for the pump; and taking a predetermined action if the monitored torque exceeds the established maximum allowable torque (T').

2. The method according to claim 1, wherein the step of taking the predetermined action comprises at least one of raising an alarm and shutting down the system.

3. The method according to claim 1, wherein the step of taking the predetermined action comprises regulating the system such that the monitored torque is reduced.

4. The method according to claim 1, wherein the step of monitoring the torque of the pump comprises monitoring a power and a speed of the pump and calculating the torque of the pump based on the monitored power and speed.

5. The method according to claim 4, wherein the step of monitoring the power and the speed of the pump comprises sampling an output power from a variable speed drive controlling said motor.

6. The method according to claim 4, wherein the step of calculating the torque of the pump comprises compensating for at least one of mechanical and electrical losses in the system.

7. The method according to claim 1, wherein the master maximum torque curve, for each differential pressure value (DP'), has a lower torque value T' than the corresponding torque values of the maximum torque curves.

8. The method according to claim 1, wherein the step of establishing the master maximum torque curve comprises positioning the master maximum torque curve adjacent to and on the permissible operating side of the maximum torque curves.

9. The method according to claim 1, wherein the step of establishing the master maximum torque curve comprises applying one of a linear or a second degree polynomial approximation algorithm to said plurality of maximum torque curves.

10. A system comprising a hydrocarbon pump and an electrical motor for driving the hydrocarbon pump, the system being configured to protect the hydrocarbon pump from excessive flow rates by performing the following steps:

for each of a plurality of gas volume fraction values of the hydrocarbon fluid, establishing a maximum torque limit for the pump by mapping a maximum allowable torque of the pump as a function of a differential pressure across the pump, thereby creating a plurality of maximum torque curves, each representing the maximum torque limit for a unique gas volume fraction value;

from the plurality of maximum torque curves, establishing a master maximum torque curve which represents the maximum torque limit for all said gas volume fraction values;

monitoring a torque of the pump and a differential pressure across the pump;

based on the monitored differential pressure (DP') and using the master maximum torque curve, establishing a maximum allowable torque (T') for the pump; and taking a predetermined action if the monitored torque exceeds the established maximum allowable torque (T').

11. The system according to claim 10, wherein the system is the subsea hydrocarbon fluid pumping system.

12. The system according to claim 10, wherein the step of taking the predetermined action comprises at least one of raising an alarm and shutting down the system.

13. The system according to claim 10, wherein the step of taking the predetermined action comprises regulating the system such that the monitored torque is reduced.

14. The system according to claim 10, wherein the step of monitoring the torque of the pump comprises monitoring a power and a speed of the pump and calculating the torque of the pump based on the monitored power and speed.

15. The system according to claim 14, wherein the step of monitoring the power and the speed of the pump comprises sampling an output power from a variable speed drive controlling said motor.

16. The system according to claim 14, wherein the step of calculating the torque of the pump comprises compensating for at least one of mechanical and electrical losses in the system.

17. The system according to claim 10, wherein the master maximum torque curve, for each differential pressure value (DP'), has a lower torque value T' than the corresponding torque values of the maximum torque curves.

18. The system according to claim 10, wherein the step of establishing the master maximum torque curve comprises positioning the master maximum torque curve adjacent to and on the permissible operating side of the maximum torque curves.

19. The system according to claim 10, wherein the step of establishing the master maximum torque curve comprises applying one of a linear or a second degree polynomial approximation algorithm to said plurality of maximum torque curves.

* * * * *